United States Patent [19]

Suda

[11] 4,063,724

[45] Dec. 20, 1977

[54] IMAGE TRANSFER DEVICE

[75] Inventor: Masashi Suda, Iruma, Japan

[73] Assignee: Canon Kabushiki Kaisha, Tokyo, Japan

[21] Appl. No.: 704,825

[22] Filed: July 13, 1976

[30] Foreign Application Priority Data

| | | |
|---|---|---|
| July 18, 1975 | Japan | 50-87968 |
| July 18, 1975 | Japan | 50-87969 |
| July 18, 1975 | Japan | 50-87970 |
| July 18, 1975 | Japan | 50-87971 |
| July 18, 1975 | Japan | 50-87972 |

[51] Int. Cl.[2] ..... B65H 29/06

[52] U.S. Cl. ..... 271/277; 271/82; 271/206

[58] Field of Search ..... 271/276, 277, 80, 82, 271/204, 206, 265

[56] References Cited

U.S. PATENT DOCUMENTS

| | | | |
|---|---|---|---|
| 1,216,668 | 2/1917 | Droitcour | 271/80 |
| 1,695,648 | 12/1928 | Giesecke | 271/276 |
| 3,508,824 | 4/1970 | Leinbach | 271/DIG. 3 |
| 3,567,213 | 3/1971 | Lagonegro | 271/277 X |
| 3,790,159 | 2/1974 | Hatzmann | 271/277 X |
| 3,884,461 | 5/1975 | Hauser | 271/277 |
| 3,942,787 | 3/1976 | Bolza-Schunemann | 271/276 X |

*Primary Examiner*—Richard A. Schacher

*Attorney, Agent, or Firm*—Fitzpatrick, Cella, Harper & Scinto

[57] ABSTRACT

An image transfer device for transferring an electrophotographically formed image onto a transfer medium comprises grip means for gripping the transfer medium, supporting and moving means for supporting the grip means and moving it cyclically in an endless form, feed means for feeding the transfer medium to be gripped by the grip means, the feed means having a movable paper guide plate disposed adjacent to the path of cyclical movement of the grip means, corona transfer means for transferring the image onto the transfer medium gripped by the grip means, separator means for separating the transfer medium from the grip means, transport means for transporting the separated transfer medium, and control means for causing all of the above-mentioned means to cooperate with one another.

16 Claims, 12 Drawing Figures

IMAGE TRANSFER DEVICE

BACKGROUND OF THE INVENTION

1. Field of the Invention

This invention relates to an image transfer device for excellently transferring an electrophotographically formed visible image onto a transfer medium, and more particularly to an improved image transfer device for excellently transferring such image in superposed relationship on an unfixed transfer image.

2. Description of the Prior Art

The known methods of transferring an electrophotographically formed visible image onto a transfer medium include the roller transfer method whereby a transfer medium is brought into contact with the surface of a photosensitive medium having a visible image formed thereon and a roller is resiliently urged against the back side of the transfer medium, the field transfer method whereby a transfer medium is brought into contact with the surface of the photosensitive medium and an electrically conductive roller is urged against the back side of the transfer medium to apply a voltage thereto, and the corona transfer method whereby a transfer medium is disposed along the photosensitive medium having a visible image formed thereon and corona discharge is imparted from the back side of the transfer medium. Various construction have been proposed to the apparatus for carrying out these methods.

Particularly, in the color copying machines for forming a colored copy image on the transfer medium, three or four image transfer steps have been effected with the transfer medium wrapped about the image transfer roller so that the visible image formed on the photosensitive medium may be transferred in superposed relationship onto the transfer medium. This is based on the above-mentioned roller transfer method and when a plurality of image transfer steps are effected, there occurs a phenomenon that the portion of the transfer medium which already bears a toner image can hardly receive a subsequent toner image during the subsequent image transfer step. Also, when the transfer medium is electrostatically attracted to the roller, if the humidity is high, the transfer medium can hardly twist about the transfer roller because of the variation in resistance of the transfer medium, and if the humidity is low, an unfavorable image transfer effect is liable to occur. Thus, the roller transfer method is inconvenient in many points to obtain a final image of good quality having a good color balance.

The roller transfer method also encounters problems in the construction and use of the apparatus therefor. For example, in a copying machine using various sizes of transfer mediums, when transfer medium of small size is in use, the toner on the image-bearing drum may stick to the portions of the transfer roller which are not covered with the transfer medium and such portions of the transfer roller may stain the back side of a large-sized transfer medium when it is subsequently used, or may cause non-uniformity of the transfer field which may result in irregularity of the transfer image, which will in turn make is indispensable to provide cleaner means for the transfer roller. Moreover, the operation of such cleaner means must take place when no transfer medium is present in the machine and thus, cumbersomeness is greatly increased.

SUMMARY OF THE INVENTION

In view of the above-noted points, it is an object of the present invention to provide an image transfer device which enables excellent superposed image transfers to be accomplished.

It is another object of the present invention to provide an image transfer device which ensures excellent image transfer to be accomplished when a plurality of image transfer steps are to be effected on a transfer medium.

It is still another object of the present invention to provide an image transfer device which enables a transfer medium after image transfer to be separated without the image on a surface thereof being disturbed or enables superposed image transfers onto the other surface of the transfer medium to be accomplished.

Generally describing the present invention, transfer medium may be reliably transported to grip means for gripping the transfer medium at the leading end thereof. The grip means gripping the transported transfer medium may be cyclically moved in an endless form a predetermined number of times to accomplish superposed transfers of predetermined color images. Thereafter, the transfer medium may be separated from the grip means and even after released from the grip, the transfer medium may still be transported for discharge by a sufficient transport force. Particularly, feed of the transfer medium to the grip means is ensured and upon occurrence of an accidental unsuccessful feed, a new image transfer step may immediately be resumed. Thus, image transfer efficiency may be improved to accomplish excellent image transfer and the transfer medium after the image transfer may be smoothly discharged out of the machine without the transfer image thereon being disturbed.

Other objects and features of the present invention will become apparent from the following detailed description of the invention taken in conjunction with the accompanying drawings.

DESCRIPTION OF THE PREFERRED EMBODIMENTS

Figure 1:
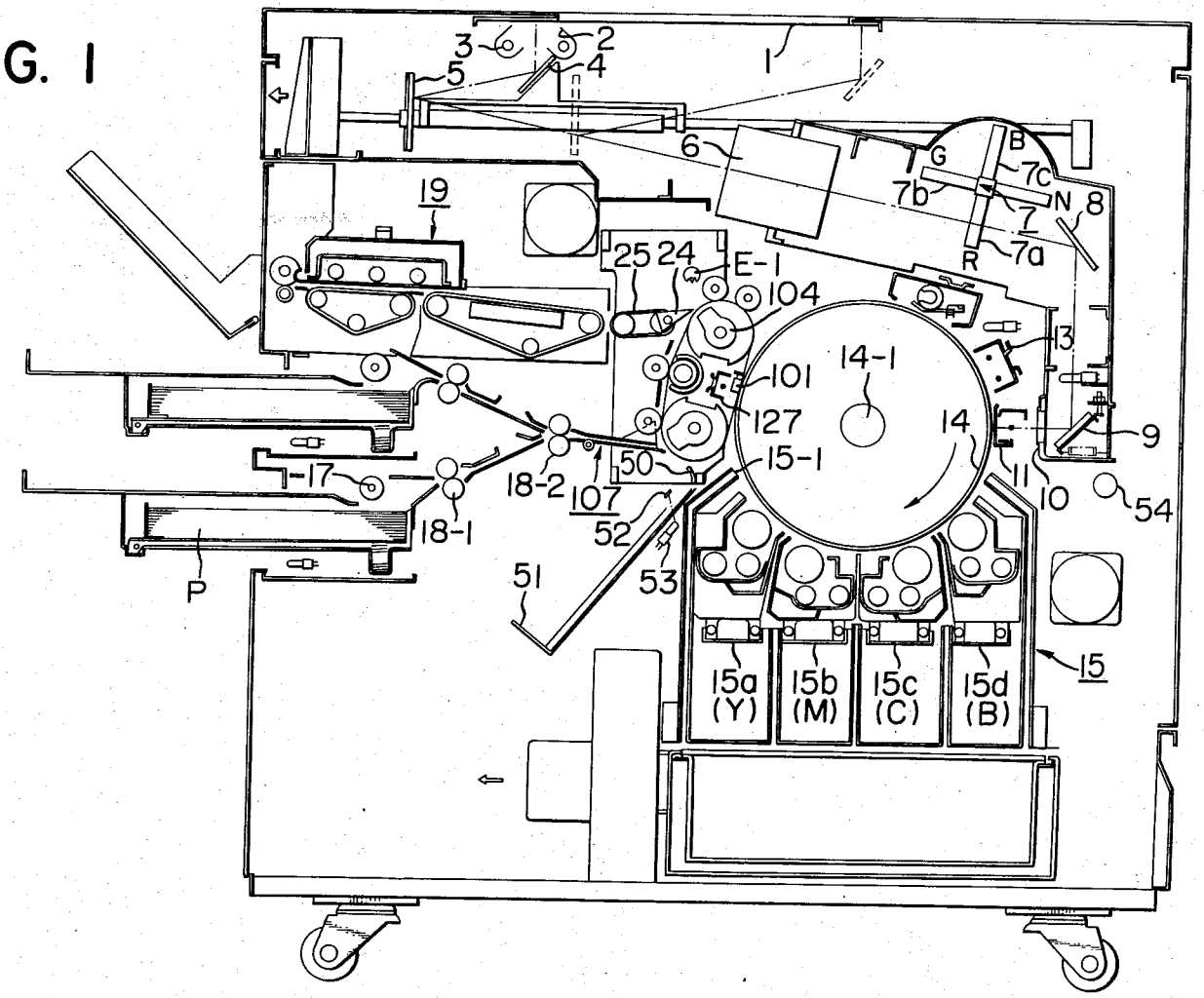
FIG. 1 is a side view of a specific copying medium to which the device of the present invention is applied.

Referring to FIG. 1, it shows a side view of an electrophotographic copying machine which employs the transfer device according to an embodiment of the present invention. Operation of the machine will first be described. An image original resting on an original carriage glass plate 1 is illuminated by an illumination system comprising iodine lamps 3 and reflectors 2 and integrally formed with a first scanning mirror 4. The light reflected by the image original is scanned by the first mirror 4 and by a second scanning mirror 5. The first and second scanning mirrors are moved at a velocity ratio of 1 : ½, whereby they scan the image original while maintaining the first half of the optical length of a lens system 6 constant at all times. The reflected image light passes through the lens 6 to a color resolving filter 7, in which the image light is color-resolved by one of filter members *7a*, *7b* and *7c* which correspond to three colors, red (R), green (G) and blue (B). The image light so color-resolved is directed via stationary third and fourth mirrors 8 and 9 and through a dust-proof sealing glass 10 and projected upon a photosensitive drum 14. The photosensitive drum 14 is rotatably mounted on a shaft $14_1$ and rotated in the direction of arrow upon initiation of copying operation so that the drum is electrostatically charged (to the positive polarity, for example) by a primary charger 13, whereafter the drum is discharged by a discharger 11 of AC or of the opposite (for example, negative) polarity to the polarity of the primary charge while being irradiated with the color-resolved image light. Thence, the photosensitive drum is subjected to uniform allover exposure by an allover exposure lamp 54, whereby an electrostatic latent image with high contrast is formed on the drum surface.

The electrostatic latent image on the photosensitive drum 14 is developed into a visible image by a developing device 15. The developing device 15 comprises four developing units 15*a*, 15*b*, 15*c* and 15*d* for cyan (C), magenta (M), yellow (Y) and black, respectively. A developing unit corresponding to a color resolving filter member (for example, the yellow developing unit 15*c* for the blue filter member *7c*) is rotated to the developing position to effect development. A sheet of transfer paper P is fed from a cassette into the machine by a paper feed roller 17 and given a first timing by a set of timing rollers 18-1 and a more accurate timing by a subsequent set of timing rollers 18-2, whereafter the transfer paper sheet is delivered into the opening of a gripper 101. When the transfer paper comes to a position deviated from a cam 102, the opening of the gripper is closed to grip the transfer paper at the leading end thereof. Subsequently, the developed image on the photosensitive drum is transferred to the transfer paper P as the paper passes between a transfer corona charger 127 and the photosensitive drum 14. If color copying is desired, the gripper with the transfer paper P gripped thereby is rotated three times to accomplish three-color transfer, whereafter separator pawls 24 and a gripper opening cam 104 are actuated to release the transfer paper from the gripper and transport it to a conveyor 25. Thereafter, the transfer paper is heated and fixed by a heating-fixing device 19 and discharged out of the machine.

The image transfer device according to the present invention is of such a construction that each portion of the transfer mechanism has a characteristic effect as will further be described with respect to a specific embodiment.

Figure 2:
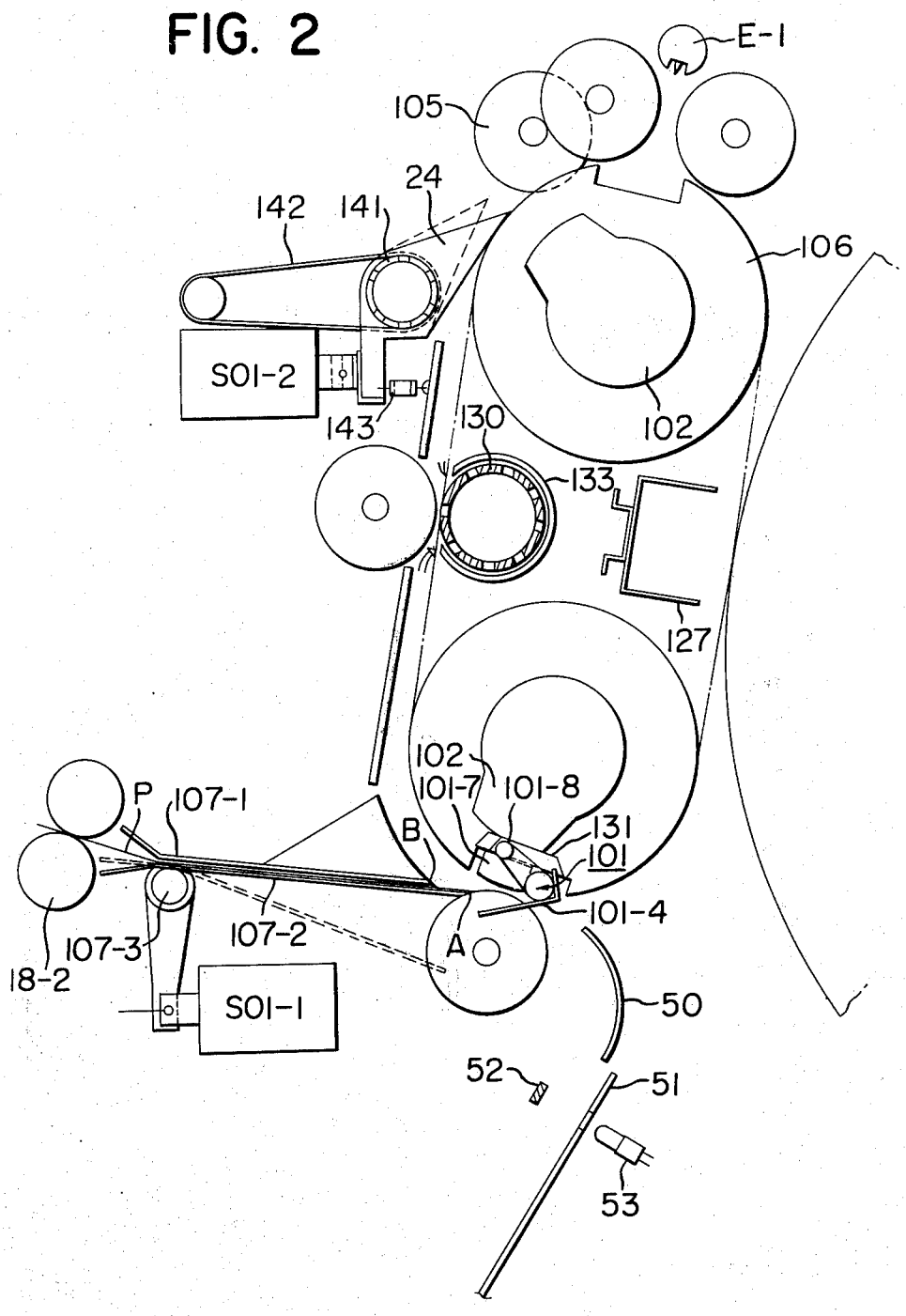
FIG. 2 is a side elevation of a specific embodiment of the device according to the present invention.
Figure 3:
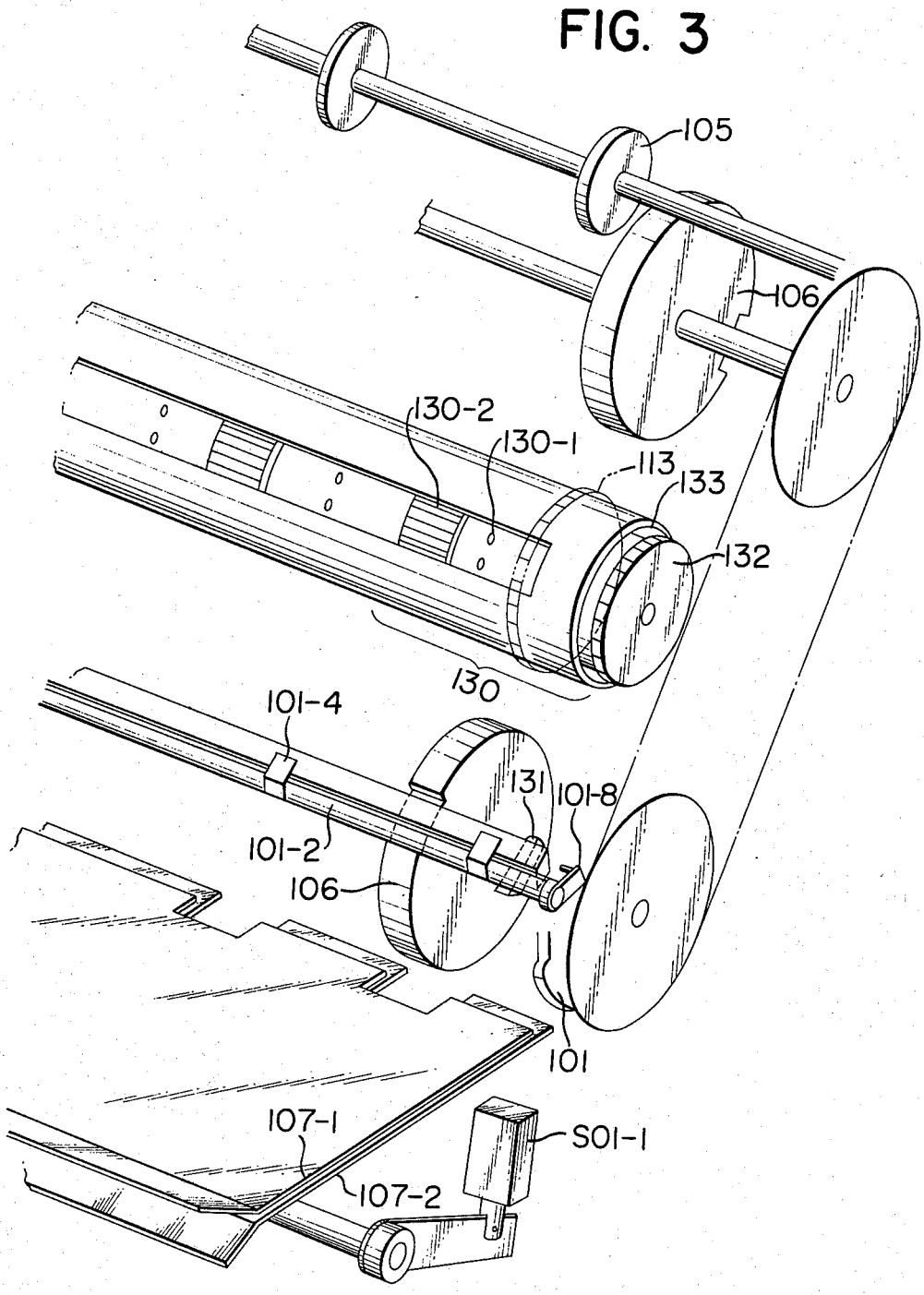
FIG. 3 is a perspective view of the same device.

FIG. 2 is a side elevation of the image transfer mechanism and FIG. 3 is a perspective view thereof.

Description will now be made of a movable transport guide provided between the timing roller set 18-2 and the transfer paper transport gripper. There is an upper guide plate 107-1 and a lower guide plate 107-2. The lower guide plate 107-2 is mounted for pivotal movement about a shaft 107-3 with respect to the upper guide plate 107-1, and may pivot downwardly from its gravity upon deenergization of a solenoid SOL-1. More specifically, the transfer paper P fed with timing imparted thereto by the timing rollers 18-2 is passed through the guide section into the gripper 101. When this occurs, the transfer paper P is being transported at a higher speed than the speed of the gripper movement and for example, if the speed of the transfer paper movement is 40% faster than that of the gripper movement, by keeping the gripper open over a length of about 12 mm, the transfer paper will be made to go into the gripper over about 5 mm and gripped thereat. At this moment, the solenoid SOL-1 is deenergized so that the lower guide imparts no resistance to the transfer paper. Moreover, the transfer paper is held within the narrow guide so that it is prevented from being wrinkled. Such construction eliminates the inconvenience such as the wrinkling of the transfer paper which may result in defective image transfer and hindrances in the subsequent transport of the transfer paper. Particularly, the paper feeding speed which is normally high but slowed down to a regular speed only during the image transfer is very effective in use and in addition, enables excellent image transfer to be accomplished without any wrinkle being formed in the transfer paper.

Description will now be made of a guide member 50, a tray 51, etc. provided adjacent to the paper gripping station of the transfer paper gripper. Paper detecting means 52, which may comprise a lamp and a light sensing element, is provided above the tray or on the passageway therein to detect entry of transfer paper. Describing the operation of this mechanism, the transfer paper transported by the second timing rollers 18-2 usually comes into the gripper 101 which is opened by an arm 101-8 riding onto the cam 102, so that even if any mistiming between the gripper and the transfer paper prevents the transfer paper from being gripped between a gripper bed 101-7 and a gripper hold 101-4, the timing rollers 18-2 continue to rotate and transport the leading end of the paper. At this time, the guide 107 is in its downward position and this, coupled with the gravity of the transfer paper, causes the leading end of the paper to be directed downwardly by the guide 50 and received into the tray 51. This reception of the transfer paper is detected by the detector means and the detection signal is used to control the operation of a jam detection control circuit which usually detects a failure of paper feed to stop the machine from operating, whereby feeding of a subsequent paper sheet may take place without the machine being stopped from operating. This will greatly reduce the loss of copying time which may result from the failure of paper feed. Moreover, such an accident will be eliminated as the surface of the photosensitive drum being injured by the unsuccessfully fed transfer paper.

The construction of the gripper portion of the image transfer device according to the present invention will further be described. As shown in FIG. 3, individual gripper pieces 101-4 are provided on a common shaft 101-2 so that transfer paper may be released from grip by the rotational pressure of the shaft. By doing so, the gripper can release its grip without the risk of deforming its bed member.

The cause and effect of the deformation of this bed member will hereinafter be set forth. The gripper portion for gripping the transfer paper must be passed through the clearance between the photosensitive medium and the image transfer corona charger and for this purpose, the thickness of the gripper portion must generally be thin, say, of the order of 8 mm. The construction of the gripper portion under such conditions would encounter the following requirements which would be difficult to satisfy. Each gripper is required to possess a sufficient holding force to grip the paper. Particularly, it is necessary that no displacement of the transfer paper occur for a plurality of image transfer steps. The small thickness of the gripper bed member may possibly cause the bed member to be deformed during release of the grip.

Especially, where the gripper bed member is thin and each gripper is individually held down by the bed member with great holding force, the grippers if simply forced up so as to release their hold might deform the bed itself so that the bed would follow the movement of the grippers, thus failing to provide a sufficient clearance for the paper to be released.

Further, according to the construction of the present device, the holding forces of the individual grippers can be made uniform by a mechanism which will hereinafter be described specifically with respect to the gripper portion.

Figure 4:
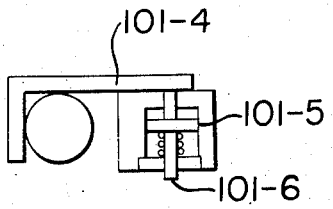
FIG. 4 is a cross-sectional view of the gripper portion of the device.
Figure 5:
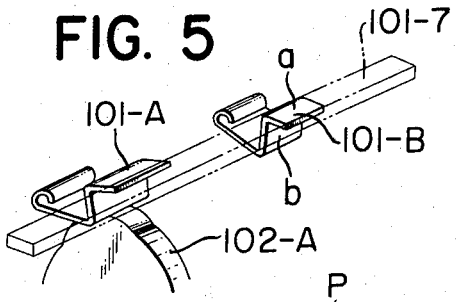
FIGS. 5 and 6 are perspective views illustrating the opening-closing mechanism for the gripper portion.

On the bed against which the grippers bear, a resiliently movable structure using a spring or the like is provided to uniformize the holding forces. More specifically, as shown in the transverse cross-sectional view of FIG. 4, the gripper 101-4 is securely mounted on the rotatively movable shaft 101-2 while a movable piece 101-5 is mounted for resilient movement on the bed 101-7 by a spring 101-6. The gripper, when in closed position, can grip the transfer paper always with an appropriate gripping force as determined by the resilient force of the spring 101-6 with respect to the holding force of the gripper. On the other hand, when the gripper in its releasing position, the movable piece 101-5 jumps up above the bed to thereby float the transfer paper up from the gripper bed, thus making the paper ready to be separated by the separator pawls. Accordingly, the transfer paper so floated up can be readily discharged from the gripper means. A modified form of the structure to facilitate such separation is shown in FIG. 5. This structure comprises a gripper 101-A and a force-up member 101-B of substantially similar construction thereto provided on the gripper bed 101-7 so that when in the paper gripping position, the gripper alone is released while the force-up member remains in intimate contact with the bed. The surface of the bed may preferably be formed with a cut-away so as to prevent the force-up member from jutting out. Thus, the leading end of the transfer paper comes onto the bed while covering the force-up member as well, and is gripped by the gripper.

Figure 6:
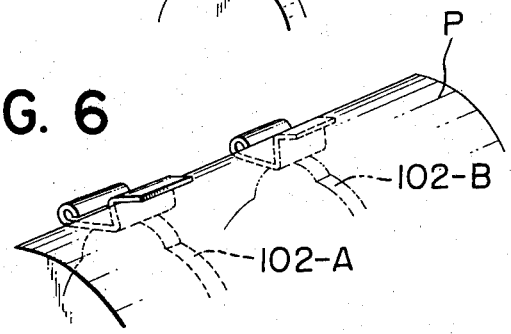
Figure 7:
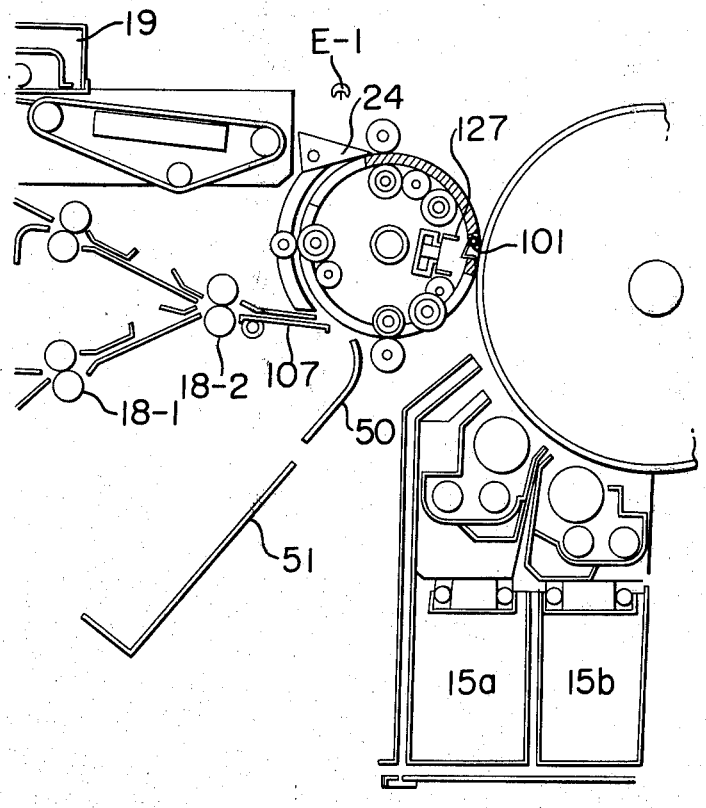
FIG. 7 is a side elevation of another embodiment of the image transfer device according to the present invention.

In the illustrated example, each gripper is released by cam projections 102A and 102B. Therefore, in the gripping position, the cam projections are in their operative position for the gripper portion alone and not for the force-up member portion. On the other hand, in the released position, the cam projections are in their operative position not only for the gripper portion but also for the force-up member portion so that, upon release of the grippers, the force-up member forces up the leading end of the transfer paper. In this case, it is preferable that the amount of projection of the cam with respect to the force-up member be smaller than the amount of projection of the cam with respect to the gripper. Alternatively, the amounts of projection of the cam with respect to the force-up member and the gripper may be equal and the length of the surface B may be changed. Thus, the separator pawls may be readily inserted underneath the leading end of the transfer paper to enable quick separation (see FIG. 6). A further modification is shown in FIG. 7, wherein a recess is provided at a portion of the gripper bed so that the separator pawls may be inserted in such recess during separation, thereby providing a similar separating effect.

In a specific embodiment of the device according to the present invention, paper detector means for checking up whether transfer paper is gripped or not is provided in the above-described transfer paper gripping mechanism to enhance the reliability of the operation thereof and to eliminate any wasteful operation such as blank transfer.

Figure 10:
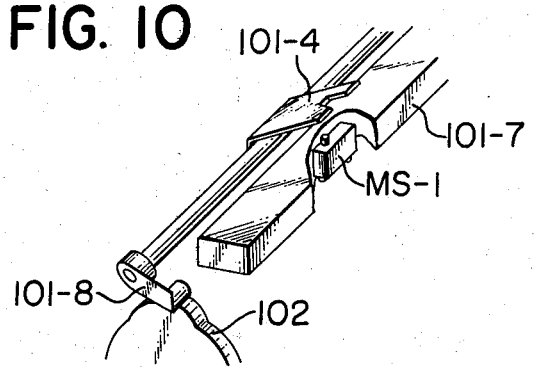
FIG. 10 is a perspective view illustrating the transfer paper detecting mechanism in the gripper portion.

As shown in FIG. 10, a recess is formed in that portion of the above-described gripper bed against which the gripper bears and means like a microswitch MS-1 is embedded in such recess, while that portion of the gripper against which the microswitch is urged is formed as a cut-away, so that when no transfer paper is present, the switch remains open but upon insertion of transfer paper, the transfer paper urges the switch with the aid of pressure force of the gripper, whereby the presence of the transfer paper is detected.

The method of detecting transfer paper is not restricted to the above-described mechanical method, but may of course be any of various methods such as the optical method using photoelectric elements and the electrical method utilizing the low conductivity of the transfer paper.

Figure 8:
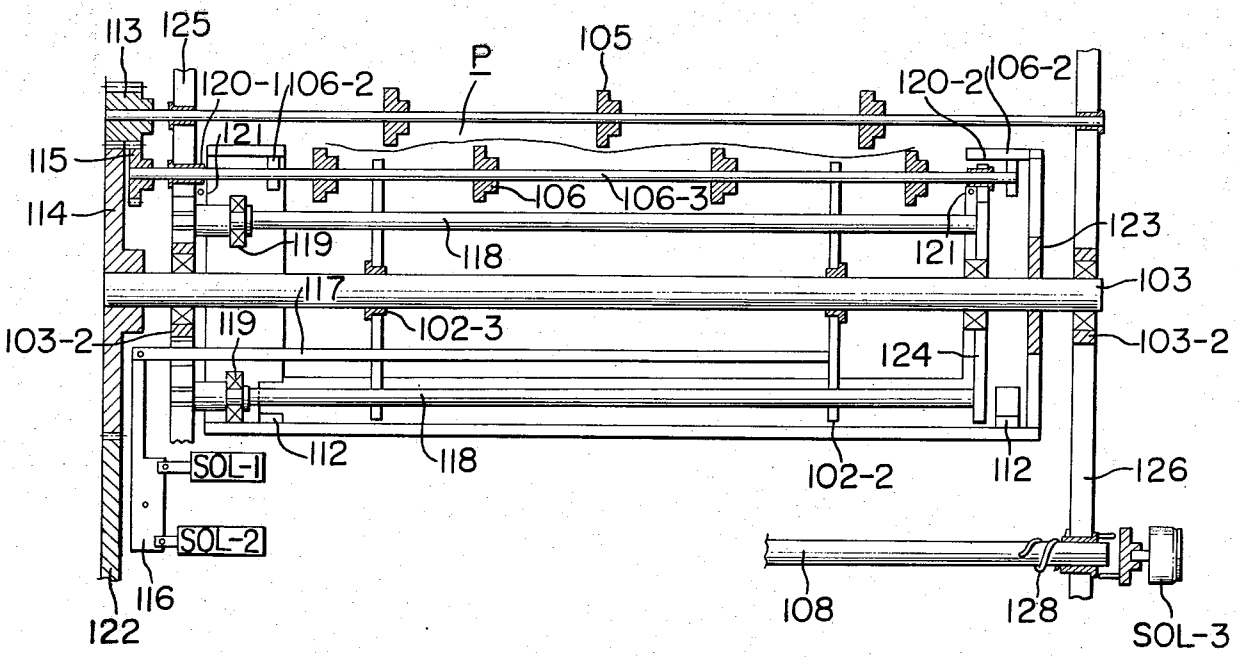
FIG. 8 is a front view of such device.

In the device of the present invention, the gripper mechanism described above may be mounted on a chain extending between and over a pair of rollers, as shown in FIGS. 1 and 3, or alternatively may be mounted on a drum formed with an opening as shown in FIG. 7 or 8, thereby gripping the transfer paper.

Also, in the device of the present invention, transport rollers may preferably be disposed just upstream of the transfer paper separating station to effect transport and separation of the transfer paper after released from the gripper.

In connection with such arrangement of the image transfer device, the grip and release of the gripper mechanism and the transport force for the transport paper after the image transfer are dependent on the movement of the photosensitive medium to the surface of which the transfer paper is attracted. Therefore, if the direction in which the transfer paper is transported by the movement of the photosensitive medium is substantially coincident with the direction in which the transfer paper is subsequently transported, no special means need not be provided, whereas said two directions are often not coincident with each other because of the construction of the device. In these cases, the transfer paper released from the gripper lacks stability of transport and may be stagnant and jammed. This is taken into account by the present device.

In FIG. 2 or 7, the transfer paper P transported through the guide 107 has its leading end gripped by the gripper 101 passing through the position of the cam 102-1 and after a predetermined number of image transfer steps has been completed, the projection of the cam 102-2 is set to its releasing position as the transfer paper passes by the cam 102-2, so that the transfer paper is released from the gripper 101 and directed to the discharge path. Before the transfer paper is so released from the gripper, a discharger E-1 is operated and the residual charge on the transfer paper is neutralized by the image transfer corona charger 127 during the image transfer, thereby preventing the transfer paper from being attracted back to the gripper or the like. On the other hand, transport rollers 105 and 106 are located at a position just upstream of the separator pawls and arranged in such a staggered relationship that these rollers are entrant with respect to each other with the gripper movement path intervening therebetween.

Thus, during the paper discharge from the image transfer device, the transfer paper P is waved in a direction parallel to the leading end edge thereof so that the transfer paper after released may be prevented from downwardly depending from its gravity. Moreover, the back side of the transfer paper is urged against the roller 106, which may thus impart a drive force to the transfer paper.

Since the transport rollers 105 and 106 are arranged in the staggered relationship as described, friction is not so strong as would be if the rollers were vertically urged against each other, and the possibility of disturbing the image on the paper is minimized.

By being waved due to the staggered roller arrangement, the transfer paper is increased in its self-support with respect to the direction of movement thereof so that it can readily ride onto the pawl-shaped separation guide and thus be separated with great ease.

Figure 9:
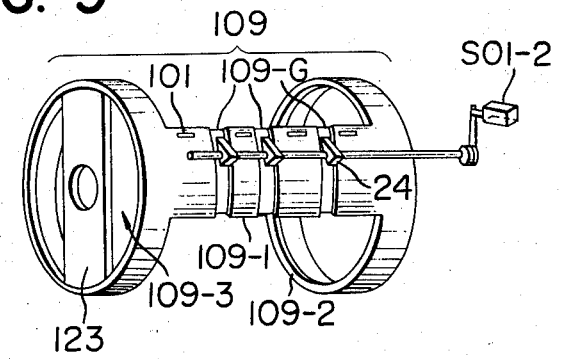
FIG. 9 is a perspective view illustrating the separating mechanism in the device.

For more excellent and reliable separation to be achieved, as shown in FIG. 9, the gripper member may be formed with a groove into which the separator pawls may enter to eliminate any failure in separation. More specifically, the separator pawls 24 are arranged to act in the area of the gripper mount bed 109-1 on which the gripper 101 is not installed, and a groove 109-G is formed in that portion of the gripper mount bed which corresponds to said area so that during operation, the separator pawls may enter into the groove to completely separate the transfer paper.

As a mechanism for increasing the transport force of the transfer paper, suction holes 141 are formed in a pipe coaxially rotatable with the rotary shaft of the separator pawls, as shown in FIG. 2. In the construction shown in FIG. 2, the pipe formed with the suction holes is rotated while the separator pawls, which are coaxially mounted with the pipe by means of bearing members, may be operated independently of the pipe. The separator pawls, as already noted, assume their solid-line position upon energization of the solenoid SOL-2 after a predetermined color image has been transferred. After having effected the separating operation, the separator pawls are returned to their broken-line position by the spring force of a spring 143.

In the device of the present invention, the gripper is designed so as to be electrically floated from the device body in order to prevent the transfer paper from being attracted to the gripper and thereby improve the efficiency of image transfer during high humidity conditions. By doing so, the charge imparted to the transfer paper by the transfer corona charger is prevented from flowing through the gripper to the device body to reduce the effect of the image transfer field.

As shown in the cross-sectional view of FIG. 8, the drum-shaped image transfer device provided with gripper is supported on the rotatable shaft thereof with the grippers being electrically insulated as by using resin material for the bearing portion thereof. On the other hand, it is recalled that the charge imparted to the transfer paper by the image transfer corona discharge is neutralized by the discharger E-1, but where a plurality of image transfer steps are to be carried out, the neutralization should preferably be effected in the last image transfer step. Otherwise, for example, if the neutralization were effected before the last image transfer step, the toner might drop off the transfer paper or might be offset onto the roller 105.

By the removal of the charge, coupled with the electrical insulation of the grippers from the device body, the transfer paper may be substantially prevented from being attracted to the grippers.

Further, in the device of the present invention, the gripper portion may effectively be connected to a power source which may apply a predetermined voltage, thereby assisting in the corona transfer which would otherwise be impeded by the passage of the gripper portion during the image transfer. This will particularly be useful during high humidity conditions under which the conductivity of the transfer paper is increased.

Furthermore, in the image transfer device according to the present invention, there is provided a baffle plate for preventing the trailing end of the transfer paper from entering the image transfer device to cause jam.

Figure 11:
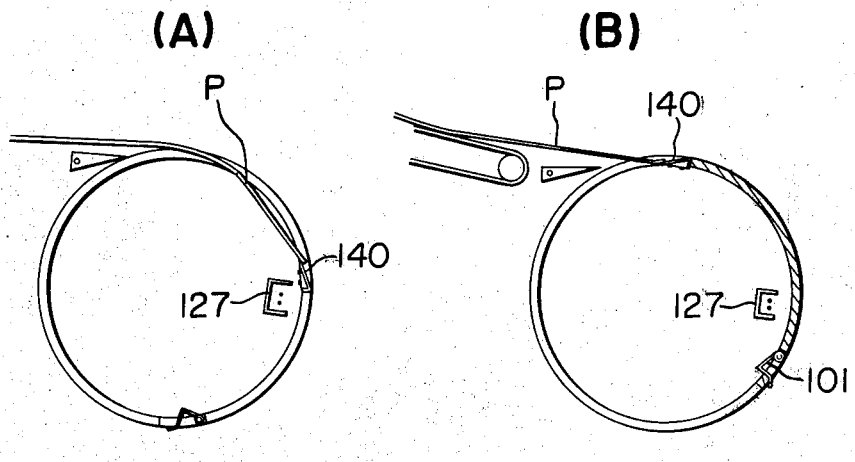
FIGS. 11(A) and (B) are side views illustrating the jam preventing mechanism in the image transfer unit.

FIG. 11 illustrates the function of such a baffle plate.

FIG. 11(A) refers to the state in which the leading end edge of the transfer paper has been released and separated while the trailing end edge has passed through the image transfer station. At this stage, the trailing end of the transfer paper tries to enter into the image transfer unit from its gravity. The transport force for the transfer paper has already been decreased by that time because the paper has been released from the grip, and therefore the trailing end edge has been caught up with by the image transfer unit. Nevertheless, since the transfer paper is being guided by the baffle plate 140, the trailing end of the paper never enters into the image transfer unit to cause jam. Thus, as shown in FIG. 11(B), the transfer paper may be safely discharged out of the image transfer unit without jamming. In the case of the shown drumshaped image transfer unit, the rear end of the drum surface to which the gripper is attached may be chamfered to perform the function described. Also, an insulative material if used to form the baffle plate will be preferable because such material will not disturb the flow of image transfer corona. In this manner, jam may be prevented which would otherwise be caused by the image transfer unit biting the trailing end of the transfer paper.

The device of the present invention, as has hitherto been described specifically, improves the feeding of transfer paper and eliminates the irregularity of image transfer which would otherwise result from the dilation of the transfer paper when gripped, thereby ensuring production of excellent transfer image. Also, the presence of detector means in the gripper mechanism or the like enables the device to quickly become ready for another image transfer cycle without wastefully continuing the image transfer operation whenever misfeeding of transfer paper has taken place as the result of shocks imparted to the machine, and the efficiency of image transfer is thus improved. Further, the transfer image is not disturbed and especially, when superposed image transfers are to be effected, excellent image transfer may be accomplished without the reproduced colors being greatly changed by variation in the transfer efficiency of the superposed images and by the scattering of the developer.

What is claimed is:

1. An image transfer device for transferring an electrophotographically formed image onto a transfer medium, comprising:

means for gripping the transfer medium;

supporting and moving means for supporting said gripping means and moving the same cyclically in an endless path;

means for feeding the transfer medium to be gripped by said gripping means, said feeding means having a movable paper guide plate disposed adjacent to the path of cyclical movement of said gripping means for guiding the transfer medium into engagement with said gripping means, and having means for moving said guide plate away from said gripping means to permit unimpeded continuous movement of the transfer medium as it is guided to said gripping means and subsequently carried away thereby;

corona transfer means for transferring said image onto said transfer medium gripped by said gripping means;

separator means for separating said transfer medium from said gripping means; and transport means for transporting the separated transfer medium.

2. An image transfer device according to claim 1, wherein said feeding means has a variable feeding mechanism for adjusting the speed of movement of the transfer medium toward the gripping means.

3. An image transfer device according to claim 2, wherein said variable feeding mechanism includes a pair of timing rollers for selective engagement to adjust said speed of movement of the transfer medium.

4. An image transfer device according to claim 1, wherein said feeding mechanism feeds said transfer medium at a higher speed than the speed of said gripping means movement when the leading end of said transfer medium is gripped by said gripping means.

5. An image transfer device for transferring an electrophotographically formed image onto a transfer medium, comprising:

means for gripping the transfer medium;

supporting and moving means for supporting said gripping means and moving the same cyclically in an endless path;

means for feeding the transfer medium to be gripped by said gripping means, said feeding means having a paper guide plate disposed adjacent to the path of cyclical movement of said gripping means for guiding the transfer medium into engagement with said gripping means;

discharge means having a guide plate disposed adjacent to said feed means for guiding a transfer medium which is unsuccessfully gripped by said gripping means;

corona transfer means for transferring said image onto said transfer medium gripped by said gripping means;

separator means for separating said transfer medium from said gripping means;

transport means for transporting the separated transfer medium; and control means for controlling the operation of all of said means to cooperate with one another.

6. An image transfer device according to claim 5, wherein said discharge means has a detecting mechanism for detecting the discharge of an unsuccessfully fed transfer medium.

7. An image transfer device according to Claim 6, wherein said control means resets each of said means to a respective image transfer starting position in response to the detection by said detecting mechanism of an unsuccessfully fed transfer medium, and thereby discontinues the image transfer operation by the cooperation between all of said means.

8. An image transfer device for transferring an electrophotographically formed image onto a transfer medium, comprising:

gripping means having a plurality of units, spaced transversely of the direction of movement of the transfer medium for gripping the transfer medium at the leading end thereof, and a regulating mechanism for regulating the applied force of each of said gripping units;

supporting and moving means for supporting said gripping means and moving the same cyclically in an endless path;

feed means for feeding the transfer medium to be gripped by said gripping means, said feed means having a paper guide plate disposed adjacent to the path of cyclical movement of said gripping means for guiding the transfer medium into engagement with said gripping means;

corona transfer means for transferring said image onto said transfer medium gripped by said gripping means;

separator means for separating said transfer medium from said gripping means;

transport means for transporting the separated transfer medium; and control means for controlling the operation of all of said means to cooperate with one another.

9. An image transfer device according to claim 8, wherein each of said gripping units of said gripping means has a support member, a finger member mounted for engagement and disengagement with the surface of its said support member, an urging mechanism for urging its said finger member toward its said support member, and a member for resiliently forcing up said finger member so as to project outwardly beyond the surface of its said support member.

10. An image transfer device according to claim 8, wherein said gripping means has a detecting mechanism for detecting the presence of a transfer medium when gripped by said gripping units.

11. An image transfer device according to claim 10, wherein at least one of said gripping units has a finger member formed with a cut-away portion, and a switch key provided on its said support member and encompassed by said cut-away portion.

12. An image transfer device according to claim 9, wherein said separator means has separator pawls for separating the transfer medium, and the surfaces of said gripping unit support members are formed with a groove into which said separator pawls are received.

13. An image transfer device for transferring an electrophotographically formed image onto a transfer medium, comprising:

grip means for gripping the transfer medium;

supporting and moving means for supporting said gripping means in an electrically insulated relationship with the body of said device and for moving said gripping means cyclically in an endless path;

feed means for feeding the transfer medium to be gripped by said grip means, said feed means having a paper guide plate disposed adjacent to the path of cyclical movement of said gripping means for guiding the transfer medium into engagement with said gripping means;

corona transfer means for transferring said image onto said transfer medium gripped by said gripping means;

separator means for separating said transfer medium from said gripping means;

discharger means disposed adjacent to said separator means to act on said transfer medium;

transport means for transporting the separated transfer medium; and control means for controlling the operation of all of said means to cooperate with one another.

14. An image transfer device according to claim 13, further comprising voltage applying means for applying a potential to said gripping means.

15. An image transfer device according to claim 13, wherein said transport means has a transport roller formed with a number of suction holes for holding the transfer medium.

16. An image transfer device according to claim 14, wherein the potential applied by said voltage applying means is opposite in polarity to a charge on the developer to be transferred.

* * * * *